US009949338B2

(12) United States Patent
Wilson

(10) Patent No.: US 9,949,338 B2
(45) Date of Patent: Apr. 17, 2018

(54) DEVICE TO ALLOW A TWO-WAY SWITCH TO OPERATE IN A MULTIPLE-SWITCH ELECTRICAL CIRCUIT

(71) Applicant: Phillip C. Wilson, Villanova, PA (US)

(72) Inventor: Phillip C. Wilson, Villanova, PA (US)

( * ) Notice: Subject to any disclaimer, the term of this patent is extended or adjusted under 35 U.S.C. 154(b) by 334 days.

(21) Appl. No.: 14/794,806

(22) Filed: Jul. 9, 2015

(65) Prior Publication Data

US 2016/0012989 A1 Jan. 14, 2016

Related U.S. Application Data

(60) Provisional application No. 62/022,192, filed on Jul. 8, 2014.

(51) Int. Cl.

| | |
|---|---|
| ***H01H 19/64*** | (2006.01) |
| ***H01H 31/10*** | (2006.01) |
| ***H01H 33/52*** | (2006.01) |
| ***H01H 33/59*** | (2006.01) |
| ***H01H 47/00*** | (2006.01) |
| ***H01H 85/46*** | (2006.01) |
| ***H05B 37/02*** | (2006.01) |

(52) U.S. Cl.
CPC ..... *H05B 37/02* (2013.01)

(58) Field of Classification Search
CPC ..... H01H 27/10; H01H 11/0006; H01H 2011/0043; H05B 37/02; Y10T 307/74; Y10T 307/747; Y10T 307/766
See application file for complete search history.

(56) References Cited

U.S. PATENT DOCUMENTS

| | | | | |
|---|---|---|---|---|
| 8,269,376 | B1 * | 9/2012 | Elberbaum | H01H 9/167 307/115 |
| 2008/0210465 | A1 * | 9/2008 | Fitch | H02G 3/00 174/481 |
| 2008/0258650 | A1 * | 10/2008 | Steiner | H05B 37/0254 315/291 |
| 2010/0079006 | A1 * | 4/2010 | Grice | H05B 37/0209 307/114 |
| 2010/0176661 | A1 * | 7/2010 | Wilson | H05B 37/0263 307/114 |
| 2011/0141647 | A1 * | 6/2011 | Garcia | H01H 23/145 361/166 |
| 2011/0202193 | A1 * | 8/2011 | Craig | G06Q 10/00 700/295 |
| 2012/0207481 | A1 * | 8/2012 | Elberbaum | G08C 23/06 398/113 |
| 2012/0262006 | A1 * | 10/2012 | Elberbaum | H02G 3/12 307/112 |

* cited by examiner

*Primary Examiner* — Jared Fureman
*Assistant Examiner* — Rasem Mourad

(57) ABSTRACT

A device to allow a two-way switch to be used in an electrical circuit comprising multiple switches. Using the invention device, the two-way switch can operate as either a three-way switch or a four-way switch in a multiple-switch electrical circuit using AC mains voltage.

11 Claims, 9 Drawing Sheets

DEVICE TO ALLOW A TWO-WAY SWITCH TO OPERATE IN A MULTIPLE-SWITCH ELECTRICAL CIRCUIT

REFERENCE TO RELATED APPLICATION

This application claims the priority benefit under 35 U.S.C. § 119(e) from U.S. Provisional Application No. 62/022,192, filed Jul. 8, 2014.

FIELD OF THE INVENTION

The present invention relates to a device and system that allows a two-way, single-pole single-throw (SPST) switch, to operate as either a three-way switch or a four-way switch in a multiple-switch electrical circuit using AC mains voltage.

BACKGROUND OF THE INVENTION

A two-way or "on/off" switch is used in an electrical circuit to toggle voltage to and from an electrical load when there is only one switch in the electrical circuit. A standard two-way switch comprises a movable toggle member and two terminals that are either connected or not connected to each other depending on the position of the movable toggle member. Other two-way switches used in electrical circuits use electronic circuitry means to connect and disconnect their two terminals.

Three-way and four-way switches are used in electrical circuits to toggle voltage to an electrical device from two or more locations. For example, two three-way switches can be used to control a light at the top of a stairway from both the top and bottom of the stairway. When more than two switch locations are required to control the electrical load, any number of four-way switches are used between the two three-way switches in the electrical circuit, e.g., an electrical circuit requiring five switches to control a single lighting fixture would contain two three-way switches and three four-way switches. Without the present invention assembly, only three-way and four-way switches can be used in electrical circuits using multiple switches.

When using "conventional wiring" for circuits containing three-way and four-way switches, each three-way and four-way switch in the electrical circuit is connected to the next switch in the electrical circuit by two "traveler wires" or "travelers". One of the two traveler wires between any two switches will carry AC Mains or "line voltage" and the other traveler of the pair will not carry line voltage. After a toggle of any switch in the electrical circuit, in one or more of the pair of traveler wires between the switches, the traveler carrying line voltage will shift to the other wire of the pair.

Certain specialty switches, typically using electronic circuitry means to connect and disconnect their terminals to and from each other are manufactured for use in electrical circuits as two-way, three-way and four-way switches. The most common specialty switches are the dimmer switch and the timer switch. Two-way timer and dimmer switches are available for use in electrical circuits that control the load from a single switch location, and three-way timer and dimmer switches are available for use in electrical circuits where the electrical load is controlled from multiple switch locations.

Some specialty switches are only manufactured for use in electrical circuits as two-way switches. For example, certain tamper-resistant key switches are only manufactured as a two-way switch and therefore cannot be used in circuits where the electrical load is controlled from multiple switch locations. Other specialty switches only manufactured as two-way switches typically use electronic circuitry means to connect and disconnect the switch's two terminals to and from each other; these switches e.g., monitor temperature levels and use pre-set temperatures to determine when to connect or disconnect the switch's terminals, e.g., an attic fan switch; use sound detection, connecting the switch's terminals when the sound level exceeds a pre-set decibel level; receive and respond to certain radio signals from a radio transmitter; receive infrared (IR) signals, similar to those emitted by a television remote control, and connect or disconnect the switch's terminals in response to particular signals; use motion detection, connecting the switch's terminals when motion is detected; or measure daylight lighting levels, e.g., an outdoor lamp switch disconnecting the switch's terminals when the amount of light outdoors exceeds a pre-set level. As two-way switches only, these switches cannot be used in electrical circuits where the electrical load is controlled from multiple switch locations.

Certain Internet-enabled Wi-Fi and Bluetooth ready two-way switches used in electrical circuits are designed to be responsive to wireless signals originating from a Smartphone device, either received directly or via a wireless router. These switches can control the electrical load in an electrical circuit from the Smartphone device, but are often only manufactured as two-way switches. Consequently these switches cannot be used in electrical circuits where the electrical load is controlled by multiple switches.

Using the invention assembly, a two-way switch, designed for use in a single-switch electrical circuit, can replace a three-way or four-way switch in an electrical circuit where the electrical load is controlled by multiple switches. By using the invention assembly, a switch manufacturer can avoid having to design and manufacture three-way or four-way variations of their specialty two-way switches, by incorporating the invention assembly circuitry into their specialty switch, or by using their specialty switch in conjunction with the standalone invention assembly. As such, a invention assembly that allows any standard or specialty two-way switch to be used in electrical circuits where the electrical load is controlled by multiple switches is novel and useful.

BRIEF DESCRIPTION OF THE FIGURES

The accompanying drawings relating to the invention assembly are for illustrative purposes only. Hereinafter, the invention assembly will be referred to as the invention device or the device.

SUMMARY OF THE INVENTION

Figure 1:
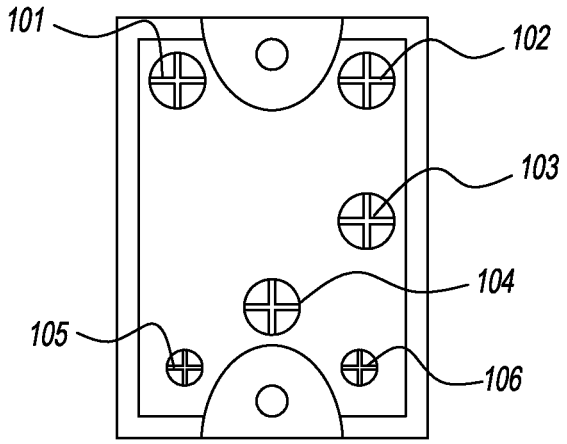
FIG. 1 shows the three-way switch design of the device with external connections.

Three-way switches are internally configured to toggle a common input terminal between two output terminals. Four-way switches are internally configured to toggle a pair of input terminals A and B to a pair of output terminals C and D, either A to C and B to D, or A to D and B to C.

The invention device uses connection means internal to the device to connect the device's input and output terminals to the same configuration as a three-way or a four-way switch. Said connection means comprise mechanical relays, solid state relays, optoisolators or optocouplers, or a microprocessor or microcontroller. In a three-way switch design, the invention device has one input terminal, two output terminals and two control terminals. In a four-way switch design, the invention device has two input terminals, two output terminals and two control terminals. In both the three-way and four-way switch designs, the two terminals of a standard or specialty two-way on/off switch, a control switch, are connected to the control terminals of the invention device. The control switch is used to manage the device's toggle.

In the three-way switch design, with the control switch in the "off" position, the device's control terminals are not connected to each other; in this configuration the device's connection means connects the device's input terminal to one of the device's output terminals; with the control switch in the "on" position the device's control terminals are connected to each other; in this configuration the device's connection means connects the device's input terminal to the device's other output terminal. In the four-way switch design, with the control switch in the "off" position, the device's control terminals are not connected to each other; in this configuration the device's connection means connects the device's input terminals to the device's output terminals, A connected to C and B connected to D. With the control switch in the "on" position the device's control terminals are connected to each other, causing the device's connection means to connect the device's input terminals to the device's output terminals, A connected to D and B connected to C. In both the three-way and four-way switch designs other switches in the electrical circuit can control the electrical load. When another switch in the electrical circuit toggles voltage to the electrical load from "off" to "on" or from "on" to "off", there is no change to the internal configuration of the device and there is no change to the position of the control switch.

When a standard or specialty two-way on/off switch is connected to the control terminals of the invention device as the control switch, the switch toggles voltage to and from the electrical load as any other three-way or four-way switch in the circuit does. Changing the position of the moveable portion of the control switch will toggle the electrical load i.e., turn the load "on" if it was "off", and "off" if it was "on". If the words "ON" and "OFF" appear on the moveable portion of the two-way switch, those words will not properly indicate whether voltage is being supplied to the electrical load. Any switch in an electrical circuit with multiple switches can toggle voltage to and from the electrical load, and when a switch other than the two-way on/off switch connected to the control terminals of the device toggles voltage to or from the electrical load, the control switch connected to the device remains unchanged, therefore if the load was "off" and the control switch shows "OFF", and another switch in the electrical circuit turns the load "on", the control switch continues to show "OFF", which would not be correct.

For certain two-way switches, especially specialty switches using electronic circuitry means to toggle the voltage to and from the load, an "event", either local or remote, triggers the toggle. The "event" could be sound, temperature, light, motion, or receiving an "on" or "off" signal from a remote device. If e.g., a two-way thermostat switch controlling an attic fan is designed to turn "on" when the temperature reaches 100 degrees and "off" when the temperature drops below 90 degrees; the thermostat switch is connected to the device as the control switch in an electrical circuit with one other standard three-way switch such that the fan can be controlled manually by the other switch and automatically by the thermostat switch; the attic fan is turned on manually with the other switch before the attic reaches 100 degrees; the fan goes "on"; then the attic temperature reaches 100 degrees. As described thus far, the outcome would be that the thermostat switch would engage, but it would toggle the switch "off" at the 100 degree point, acting as a three-way switch, but this is not the desired result in this instance.

Another example is a two-way overhead motion detection switch installed in a bathroom and connected to the device as the control switch; the motion switch is set to turn "on" after detecting motion, then to conserve energy, turn "off" after 15 minutes without motion. To further conserve energy, there is a second switch next to the door in the same electrical circuit to allow a bathroom occupant to manually turn the light "off" upon exiting. If an occupant were to enter the bathroom, the motion switch would turn the light on; then, upon exiting the occupant turns the light switch next to the door off, the light would immediately go "off" but after 15 minutes without motion, the motion switch would toggle, but as described thus far the result would be that the motion switch would toggle the lights back "on" which is not the desired result.

The three-way switch device has an additional electronic circuitry module called an "intelligent switching" module. If the three-way switch device is installed at the "load" side of the electrical circuit, using the "intelligent switching" module, the device can detect whether voltage is being supplied to the load, and e.g., upon receiving an "on" request from the control switch "intelligently" deciding whether voltage is already being supplied to the load and if so, not toggle the device, i.e., do nothing; or if the device receives an "off" request, to only toggle the device "off" if the circuit is "on", i.e., supplying voltage to the load.

The "intelligent switching" module can also function in a four-way switch device or in the line side three-way switch device. Since the load side three-way switch device is the only position in the electrical circuit where the on/off status of the load can be accurately determined, a four-way switch device or the line side three-way device in the electrical circuit would need to be connected to the load side three-way switch device via a conductor or other means to provide an on/off signal to each switch in the circuit indicating the on/off status of the load.

An example using the "intelligent switching" module is a two-way Internet-enabled Wi-Fi ready two-way switch designed to be responsive to wireless signals originating from a Smartphone device via a wireless router connected as the control switch on a load side three-way switch device in an electrical circuit. Any three-way or four-way switch in the electrical circuit can control whether voltage is being supplied to the electrical load. In addition, an "on" signal originating from the software application associated with the Internet-enabled Wi-Fi switch running on the Smartphone will toggle the load "on" if it is "off" and will not toggle if the load is already on; and an "off" signal will toggle the load "off" only if it is "on".

Typically when standard and specialty two-way switches connect and disconnect voltage to and from the load in an electrical circuit, one of the switch's terminals is constantly connected to AC mains voltage, and movement of the toggle portion of the switch causes the circuit to be energized or de-energized. Some specialty two-way switches are designed to power their internal electronic circuitry using the voltage derived from the terminal that is constantly connected to line voltage. Although the device uses the process of connecting and disconnecting the control switch's terminals to and from each other to toggle the three-way or four-way switch design, the device can provide constant voltage to one of the terminals if required to power internal electronic circuitry.

In an electrical circuit comprising multiple switches, line voltage is only being constantly provided to one terminal on one switch in the entire electrical circuit, the "common" terminal of the line side three-way switch. The other terminals on the line side three-way switch and all of the terminals on all of the other three-way and four-way switches in the electrical circuit may or may not have line voltage, depending on the toggle position of each switch in the electrical circuit. As such, since there is no single terminal on each switch to constantly provide voltage to energize the device's electronic circuitry, a "power selector" circuit is used to draw voltage from a terminal that has line voltage in each toggle configuration.

DESCRIPTION OF THE RELATED ART

U.S. Pat. No. 8,022,577 to Grice teaches the replacement of a three-way switch in a multiple switch electrical circuit with a device to sense when a toggle of any switch in the circuit takes place. The present invention relates to the replacement of a three-way or four-way switch in a multiple switch electrical circuit with a device that allows a two-way switch to control the circuit's electrical load.

U.S. Pat. No. 8,373,313 to Garcia et al. teaches a single switch design that can operate as a two-way switch, three-way switch, or four-way switch in an electrical circuit. The switch is a self-contained device including all switching mechanisms within the device and as such cannot be used to incorporate specialty switches into a multiple switch circuit. The present invention is a device that allows any standard and specialty two-way switch to be incorporated into an electrical circuit containing multiple switches as either a three-way or four-way switch, while continuing to take advantage of the specialty nature of the two-way switch in the multiple switch circuit.

DESCRIPTION OF THE INVENTION

As used herein, the term "electrical circuit" means a voltage path comprising an AC mains voltage supply, an electrical load, and one or more electrical switches used to toggle the AC mains voltage to and from the electrical load. The term "two-way switch" means a single-pole single-throw (SPST) switch comprising two terminals that are either connected to each other or not connected to each other; a two-way switch uses either a two-position toggle member or electronic circuitry means to connect and disconnect the terminals. The term "three-way switch" means a single-pole double-throw (SPDT) switch for use with AC mains voltage, comprising a two-position toggle member, one input terminal and two output terminals, the input terminal connected to one or the other of the output terminals, depending on the position of the toggle member. The term "four-way switch" means a double-pole double-throw (DPDT) switch for use with AC mains voltage, comprising a two- position toggle member, two input terminals and two output terminals, wired as an "intermediate switch" or "crossover switch" that is, a switch in which the two input terminals A and B are connected to the two output terminals C and D, either A to C and B to D, or A to D and B to C, depending on the position of the toggle member.

The present invention provides a means for using a two-way switch in an electrical circuit comprising multiple switches. Using the invention device, the two-way switch can operate as either a three-way switch or a four-way switch in a multiple-switch electrical circuit using AC mains voltage.

Referring to FIG. 1, the three-way switch design of the device comprises a "common" terminal 101 for connection to the load in the electrical circuit if the device is located at the load side three-way position, or for connection to AC Mains if the device is located at the line side three-way position in the electrical circuit; an L1 terminal 102 and an L2 terminal 103, each for connection to one of the two traveler wires between the switches; a neutral terminal 104 for connection to AC mains neutral; and an S1 terminal 105 and an S2 terminal 106 for connection to the two-way control switch.

Figure 2:
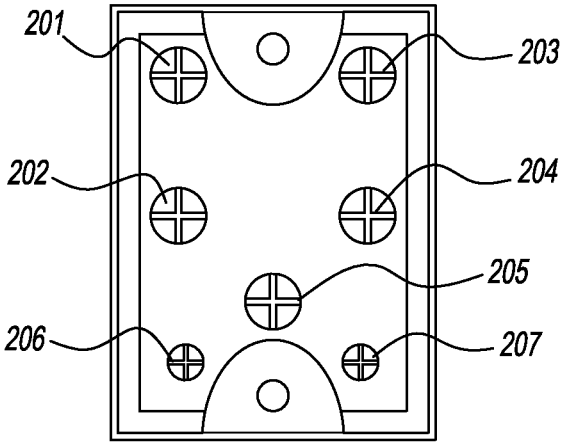
FIG. 2 shows the four-way switch design of the device with external connections.

Referring to FIG. 2, the four-way switch design of the device comprises two input terminals 201, 202 for connection to the two traveler wires from the previous switch in the electrical circuit; two output terminals 203, 204 for connection to the two traveler wires to the next switch in the electrical circuit; a neutral terminal 205 for connection to AC mains neutral; and an S1 terminal 206 and an S2 terminal 207 for connection to the two-way control switch.

The device connection points are shown as screw-down terminals attached to one side of the device in FIG. 1 and FIG. 2; some or all of the screw-down terminals could be on the sides the device, the device could have other forms of terminals such as wiring holes, the connection points could comprise electrical conductors originating from the device, or the connection points could be a combination of terminals and conductors.

Figure 3:
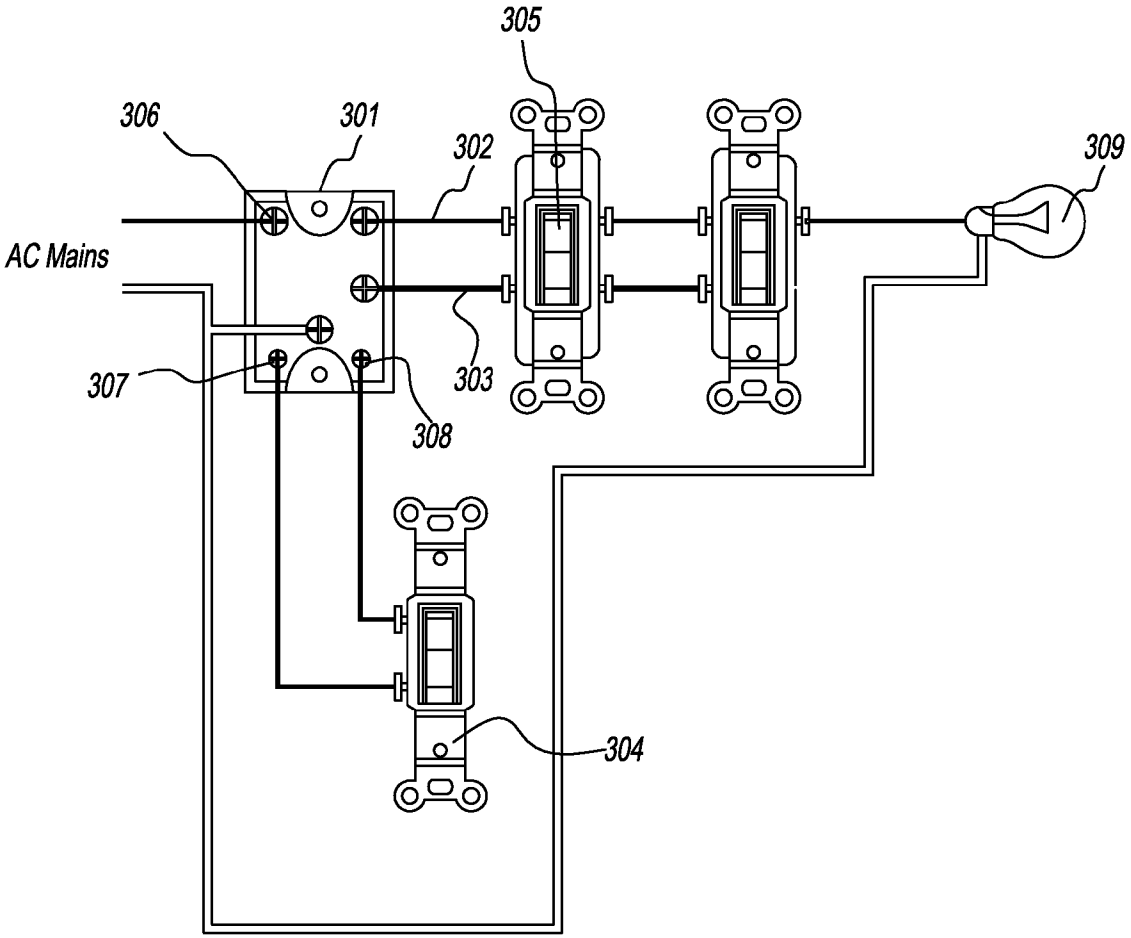
FIG. 3 shows the three-way design of the device in an electrical circuit with the device at the AC Mains position or the "line side".

Referring to FIG. 3, the three-way design of the device 301 in an electrical circuit with the device at the line side, "common" terminal 306 is connected to AC Mains; two travelers 302, 303, connect the device to a standard four-way switch 305 in the circuit; and two-way control switch 304 is connected to the device 301 at the S1 terminal 307 and S2 terminal 308. If voltage is being supplied to the electrical load 309, a toggle of control switch 304 from "on" to "off" or from "off" to "on" will cause the device 301 to disconnect voltage from the load 309 in a manner identical to a standard three-way switch. If voltage is not being supplied to the electrical load 309, a toggle of control switch 304 from "on" to "off" or from "off" to "on" will cause the device 301 to provide voltage to the load 309.

Figure 4:
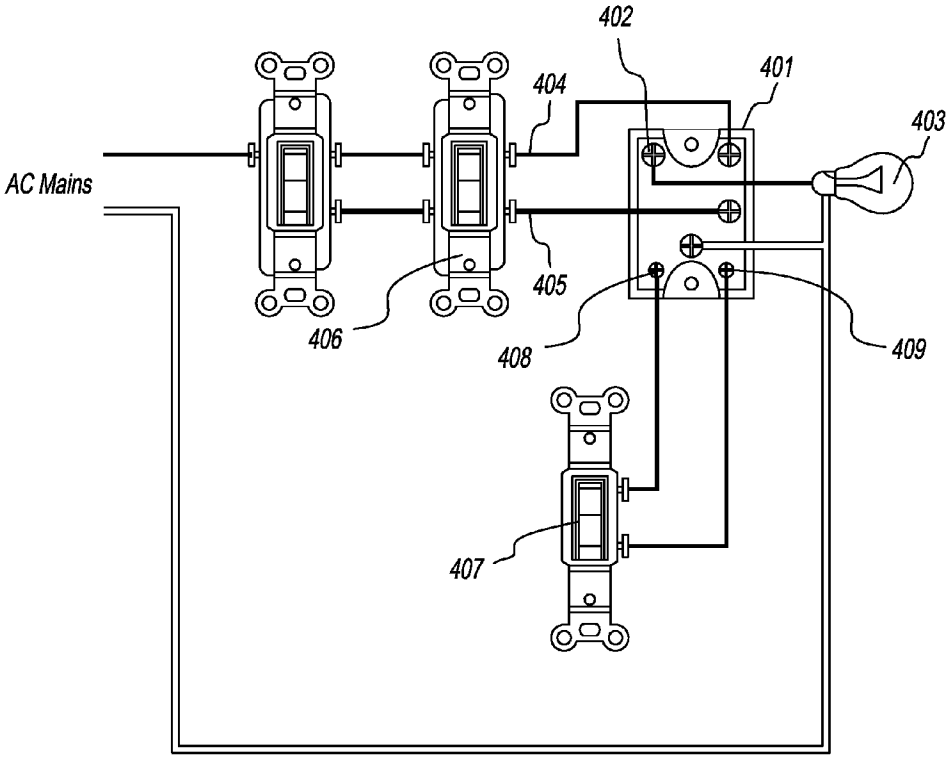
FIG. 4 shows the three-way design of the device in an electrical circuit with the device at the "load side" of the circuit.

Referring to FIG. 4, the three-way design of the device 401 in an electrical circuit with the device at the load side, "common" terminal 402 is connected to the load 403; two travelers 404, 405, connect the device to a standard four-way switch 406 in the circuit; and two-way control switch 407 is connected to the device 401 at the S1 terminal 408 and S2 terminal 409. If voltage is being supplied to the electrical load 403, a toggle of control switch 407 from "on" to "off" or from "off" to "on" will cause the device 401 to disconnect voltage from the load 403. If voltage is not being supplied to the electrical load 403, a toggle of control switch 407 will cause the device 401 to provide voltage to the load 403.

Figure 5:
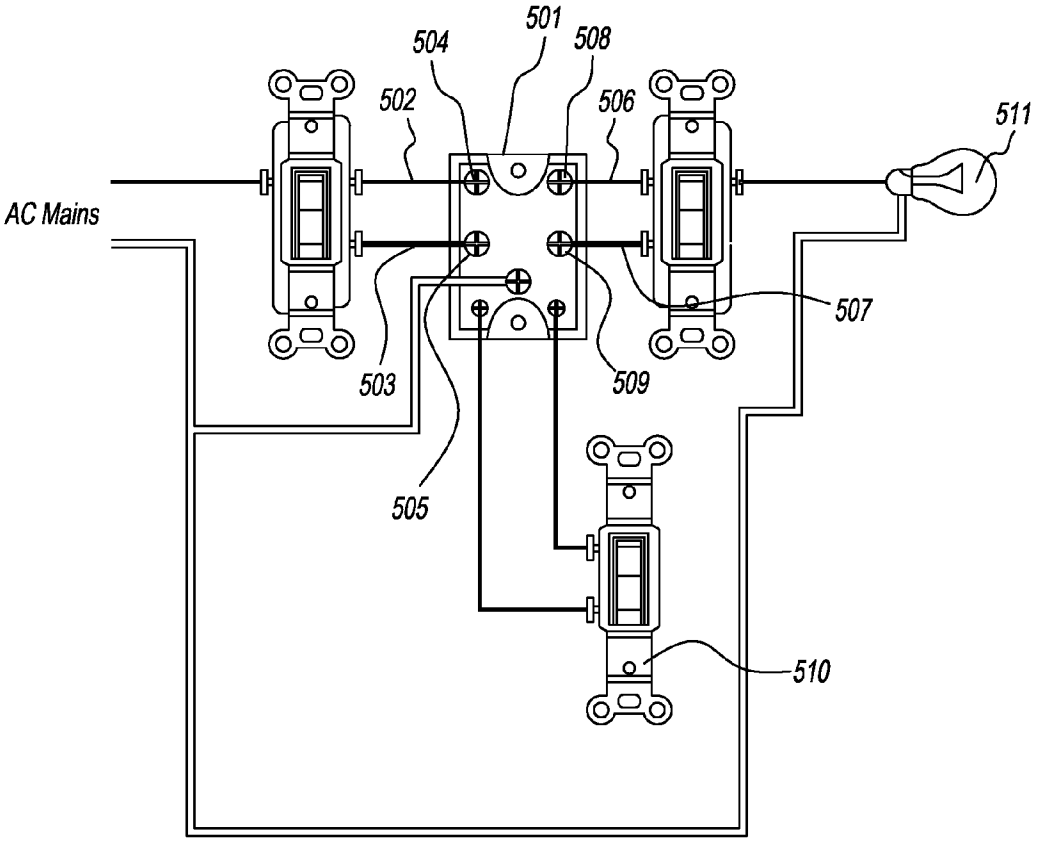
FIG. 5 shows the four-way design of the device in an electrical circuit.

Referring to FIG. 5, the four-way design of the device 501 in an electrical circuit, two travelers 502, 503 from the previous switch in the circuit are connected to input terminals 504, 505 on the device 501, and two travelers 506, 507 connecting the next switch in the electrical circuit are connected to output terminals 508, 509. Internal to the device 501, the terminals are either connected in a first connection configuration where a first input terminal 504 is connected to a first output terminal 508 and a second input terminal 505 is connected to a second output terminal 509, or in a second connection configuration where the first input terminal 504 is connected to the second output terminal 509 and the second input terminal 505 is connected to the first output terminal 508. If the device 501 is in the first connection configuration, a toggle of control switch 510 will cause the terminals to arrange in the second connection configuration, and if the device 501 is in the second connection configuration, a toggle of control switch 510 will cause the terminals to arrange in the first connection configuration. If voltage is being supplied to the electrical load 511, a toggle of control switch 510 from "on" to "off" or from "off" to "on" will cause the device 501 to disconnect voltage from the load 511, and if voltage is not being supplied to the electrical load 511, a toggle of control switch 510 from "on" to "off" or from "off" to "on" will cause the device 501 to provide voltage to the load 511.

FIG. 6, FIG. 7, FIG. 8, and FIG. 10 are component diagrams of the device. The diagrams are being used for illustrative purposes. These component diagrams do not represent actual working circuits. Certain resistors and capacitors to manipulate voltage and current levels in parts of the circuit are not present, and certain diodes or other means to prevent the backflow of voltage in parts of the circuit are not shown. There are many ways to perform the tasks that are being described using different electronic circuitry; these component diagrams illustrate one way.

Figure 6:
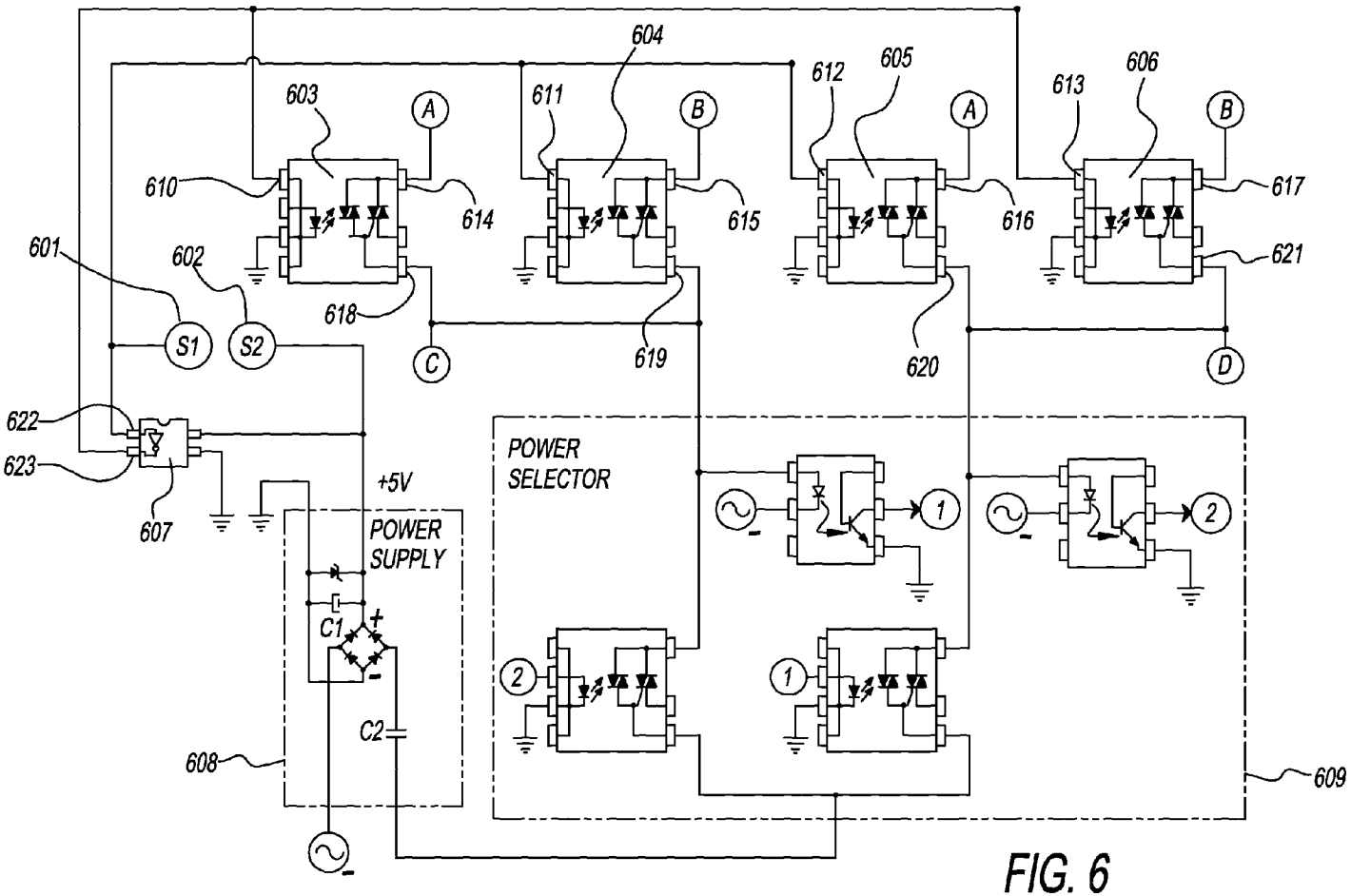
FIG. 6 shows a component diagram of the four-way design of the device.

FIG. 6 shows a component diagram of an "internal switching mechanism" for a four-way design of the device. The diagram shows four optocouplers 603, 604, 605, 606, an inverter logic gate 607, a power supply circuit 608, and a "power selector" circuit 609. A two-way on/off control switch would be connected across the S1 terminal 601 and the S2 terminal 602. Each optocoupler is connected to one of the device's two input terminals and one of the device's two output terminals. When an optocoupler 603, 604, 605, 606 receives +5 VDC on its anode pin 610, 611, 612, 613, its collector pin 614, 615, 616, 617 is connected to its emitter pin 618, 619, 620, 621. A first optocoupler 603 is connected at its collector pin 614 to a first input terminal A, and at its emitter pin 618 to a first output terminal C. A fourth optocoupler 606 is connected at its collector pin 617 to a second input terminal B and at its emitter pin 621 to a second output terminal D. The anode pin 610 of first optocoupler 603 and the anode pin 613 of fourth optocoupler 606 are connected to each other therefore they both receive +5 VDC at the same time, connecting their respective collector and emitter pins at the same time and causing input terminal A to connect to output terminal C at the same time that input terminal B is connected to output terminal D. When both the anode pin 611 of a second optocoupler 604 and the anode pin 612 of a third optocoupler 605 receive +5 VDC, their respective collector and emitter pins are connected at the same time, causing input terminal B to connect to output terminal C at the same time that input terminal A connects to output terminal D. When the S1 terminal 601 and the S2 terminal 602 are not connected, i.e., the control switch is "off", the inverter gate 607 input pin 622 receives +OV therefore the output pin 623 receives +5 VDC, and feeds +5 VDC to the anode pin 610 of first optocoupler 603 and the anode pin 613 of fourth optocoupler 606, causing input terminal A to connect to output terminal C at the same time that input terminal B connects to output terminal D. When S1 terminal 601 and the S2 terminal 602 are connected, i.e., the control switch is "on", the inverter gate 607 input pin 622 receives +5 VDC which is also connected to the anode pin 611 of the second optocoupler 604 and the anode pin 612 of the third optocoupler 605, causing input terminal B to connect to output terminal C at the same time that input terminal A connects to output terminal D.

One of output terminal C or output terminal D will always contain voltage. With each toggle of the device, the power selector circuit 609 draws voltage from whichever terminal contains voltage in order to provide AC Mains voltage to the power supply circuit 608, which in turn provides +5 VDC to the device's electronic circuitry. The device could alternatively use a battery, a capacitive charge circuit, or other means for power selection and power supply.

Figure 7:
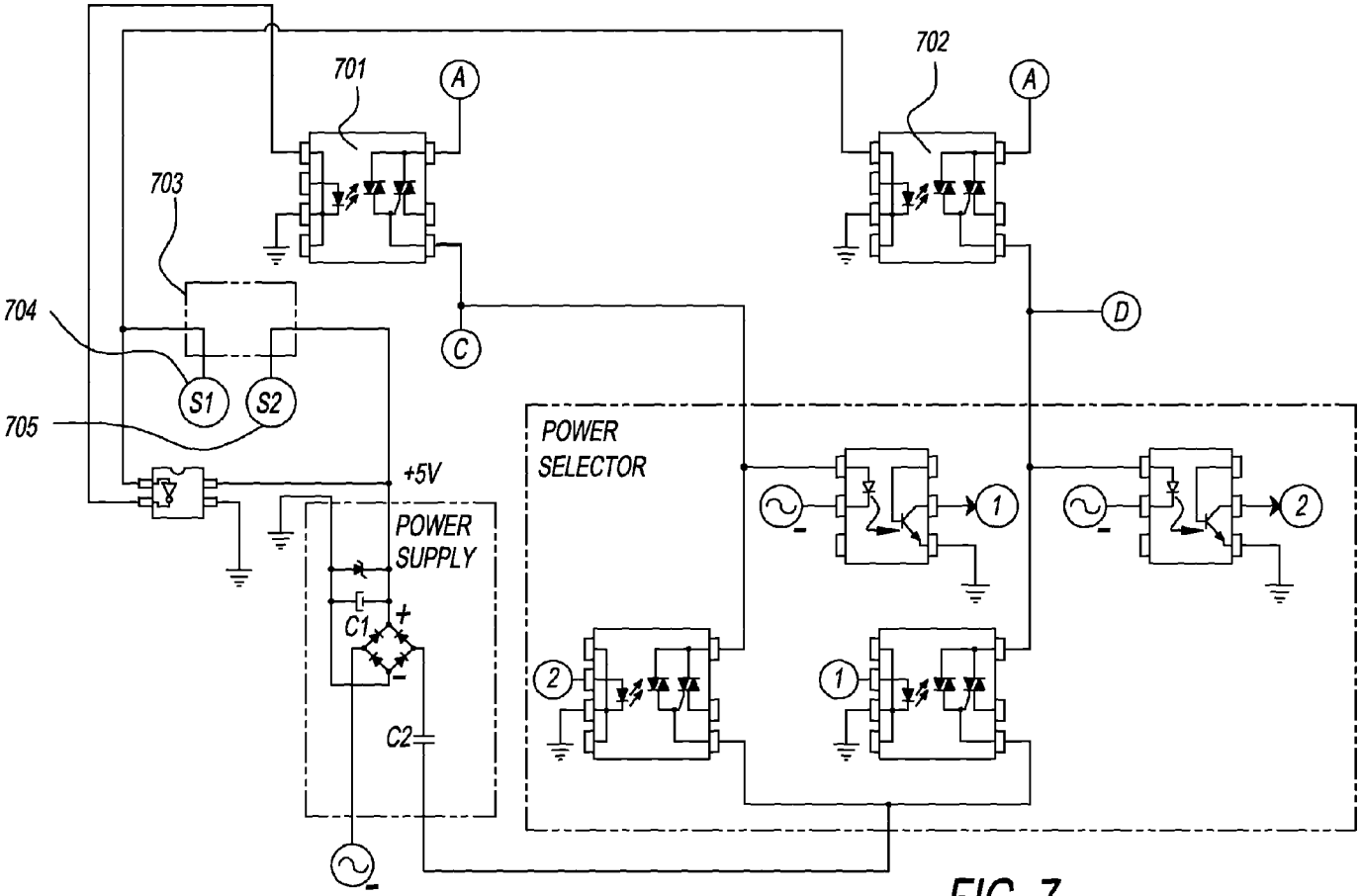
FIG. 7 shows a component diagram of the three-way design of the device.
Figure 8:
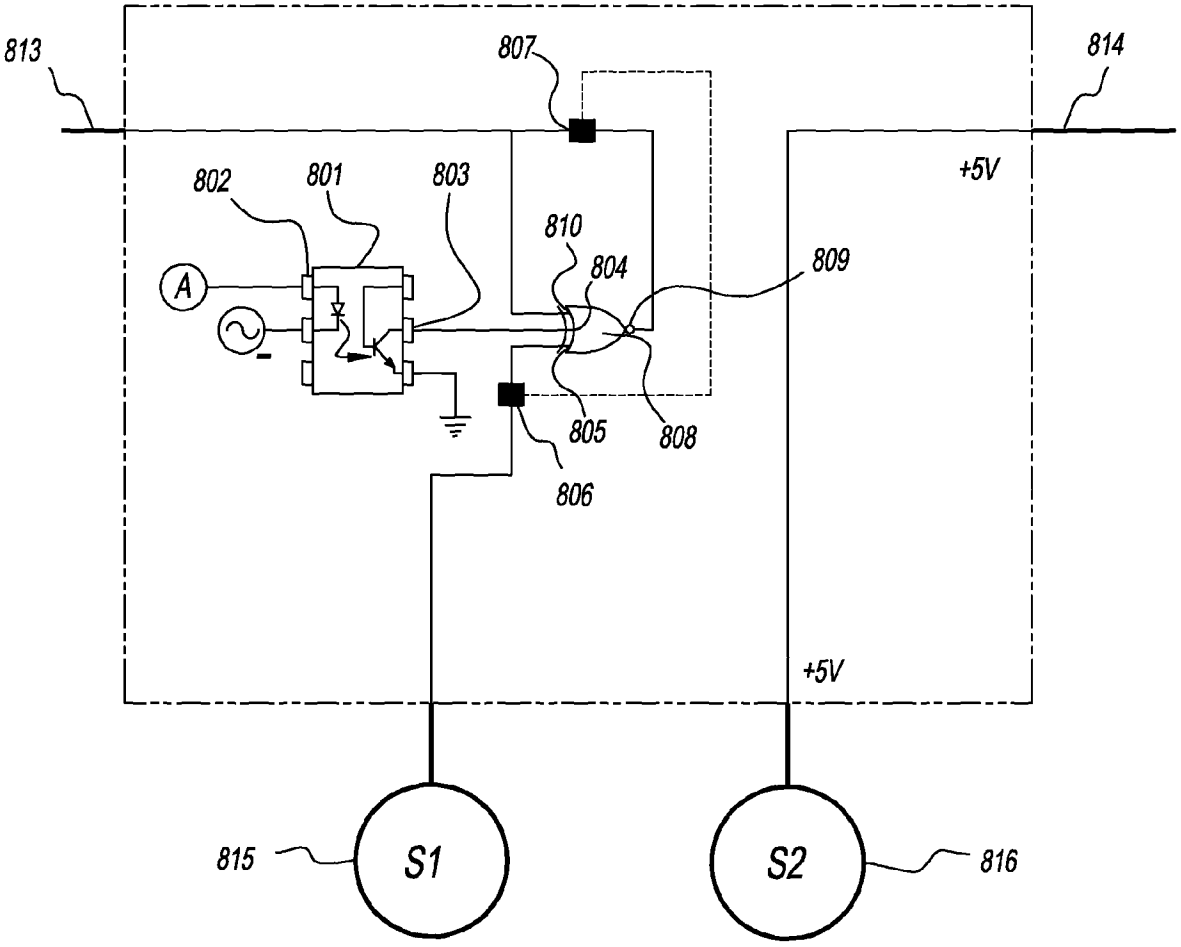
FIG. 8 shows a component diagram of the "intelligent switching" circuit module in the three-way design of the device.
Figure 10:
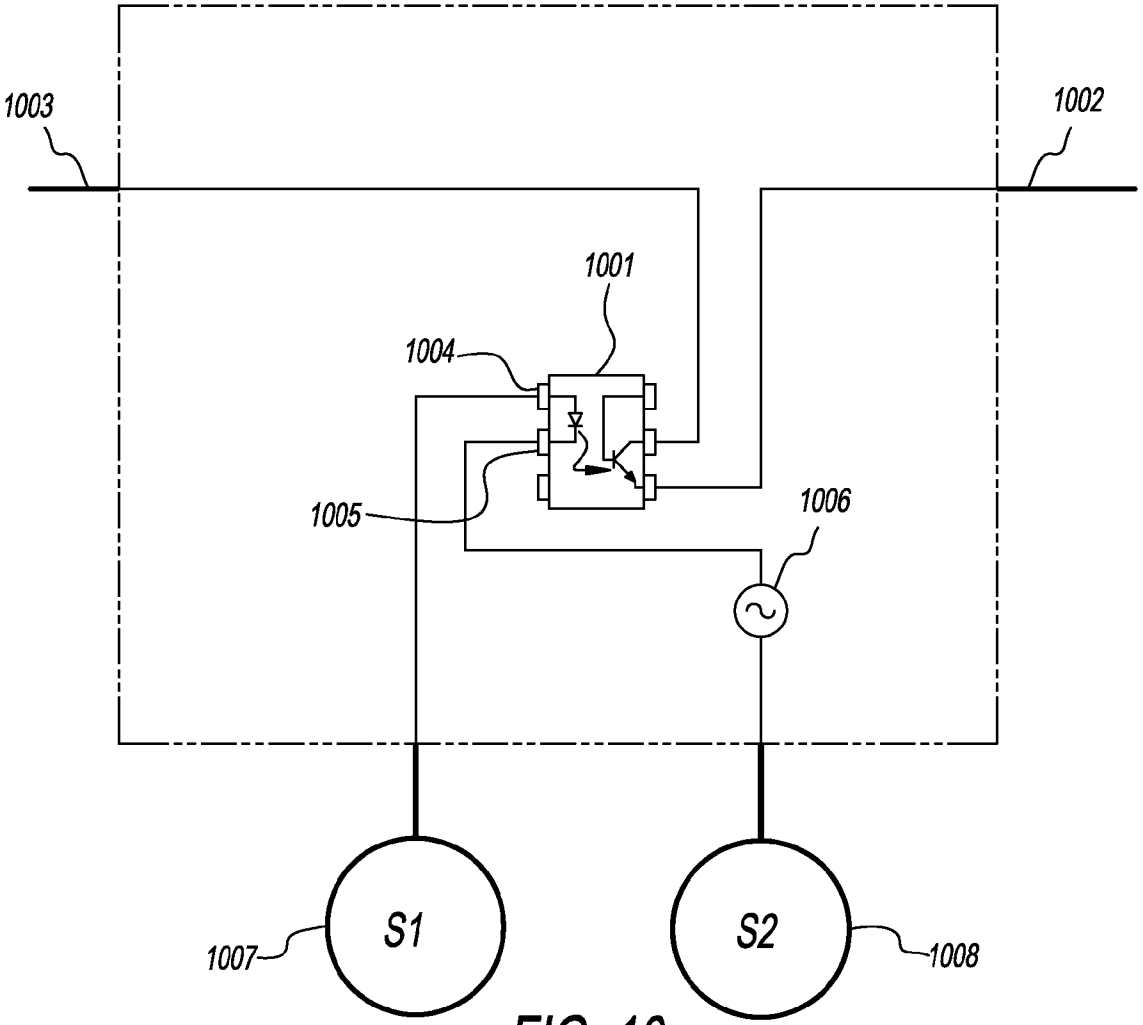
FIG. 10 shows a component diagram of the "power source" circuit module in the three-way design of the device.

FIG. 7 shows a component diagram of an "internal switching mechanism" for a three-way design of the device. The three-way design circuit requires two optocouplers 701, 702 connecting the one input terminal A to one of the two output terminals C or D. In all other respects, the three-way design circuit works the same as four-way design circuit. FIG. 8 and FIG. 10 show two additional features relating to the three-way design circuit. These features are inserted in an area 703 in the circuit immediately after the S1 terminal 704 and the S2 terminal 705.

FIG. 8 shows a component diagram of the "intelligent switching" circuit module in the three-way design for use on the load side of the electrical circuit. The anode pin 802 of an optocoupler 801 is connected to terminal A, the "common" terminal. On the load side three-way switch device, terminal A has AC Mains voltage when the load is energized and does not have AC Mains voltage when the load in not energized, therefore the collector pin 803 of the optocoupler 801 will have +5 VDC when voltage is being provided to the load. Since the collector pin 803 of the optocoupler 801 is connected to the B input 804 of a three-input XOR gate 808, the B input 804 will have +5 VDC when voltage is being provided to the load. The XOR gate 808 is shown as a separate gate for convenience; the XOR gate 808 would actually be within an integrated chip. The S1 terminal 815 is connected to the A input 805 of the XOR gate 808, therefore since the S2 terminal 816 is connected to a +5 VDC source, the A input 805 will have +5 VDC when the control switch between the S1 terminal 815 and the S2 terminal 816 is in the "on" position, i.e., when the S1 terminal 815 and th2 terminal 816 are connected to each other. Not shown in detail, a first box 807 represents a latch sub-circuit that stores a "last state" of the "intelligent switching" circuit, i.e., whether the +5 VDC from the power supply on input lead 814 is being connected to output lead 813 via the XOR gate 808, and uses this information as the C input 810 to the XOR gate 808. This "last state" information stored as "0" or "1"

represents whether the device is in the first connection configuration or the second connection configuration and is necessary after a toggle of the control switch in order to determine the "next state" of the "intelligent switching" circuit. The trigger to the sub-circuit represented by the first box 807 is another sub-circuit represented a second box 806 that detects a 1 terminal 815 change-of-state, i.e., when a toggle takes place on the control switch. Therefore, when the control switch toggles from "on" to "off" or from "off" to "on", that change-of-state or toggle is detected by the sub-circuit represented a second box 806 and causes the sub-circuit represented a first box 807 to store the output of the XOR gate 808, the "last state" of the "intelligent switching" circuit. This "last state" information is used to determine the "next state" at the next toggle of the control switch. The "next state" of the "intelligent switching" circuit depends on the three inputs to the XOR gate 808; the "last state" or how the device connection means are currently configured; whether the control switch is in an "on" or "off" position; and whether voltage is being provided to the load in the electrical circuit.

The "next state" is only determined at the time of a change-of-state or toggle of the control switch, e.g., if another switch in the electrical circuit caused voltage previously on the load side "common" terminal A to be removed, the anode pin 802 of optocoupler 801 connected to terminal A would cause the collector pin 803 to go low i.e., have +0 VDC. Since the collector pin 803 is connected to the B input 804 of the XOR gate 808, this may cause the output 809 on the XOR gate 808 to change its output state, however since box 806 did not trigger a change-of-state of the control switch to box 807, the output lead 813 will continue to have the "last state" rather than what is currently on the output pin 809 of the XOR gate 808.

Figure 9:
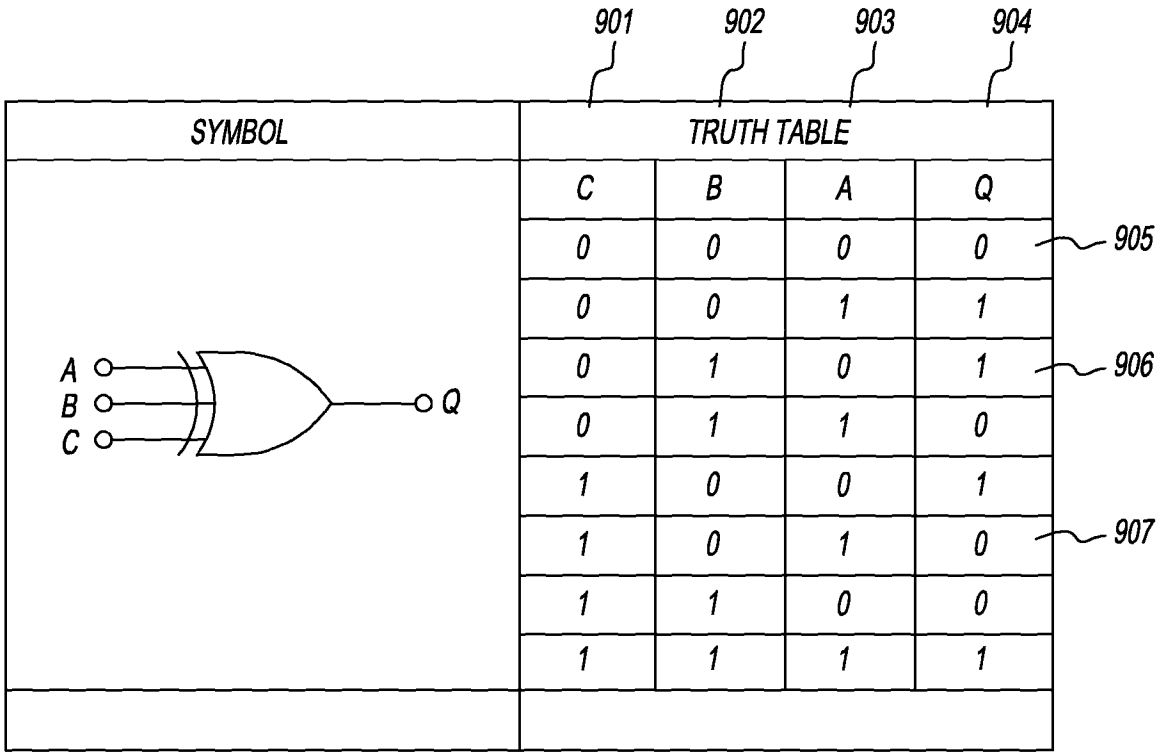
FIG. 9 PRIOR ART
FIG. 9 shows a truth table for the three-input XOR gate used in the "intelligent switching" circuit.

Referring to both FIG. 8 and FIG. 9, FIG. 9 shows a truth table that shows three input columns, A, B, and C and a resultant output column Q for the three-input XOR gate component 808 of the "intelligent switching" circuit module shown in FIG. 8. Column B 902 represents the output from the optocoupler 801, the B input 804 to XOR gate 808 with "0" representing +0 VDC and "1" representing +5 VDC. Column B 902 therefore indicates whether voltage is being provided to the load in the electrical circuit, "1" representing "yes" and "0" representing "no". Column A 903 represents the A input 805, whether +5 VDC is on the S1 terminal 815 and therefore whether the control switch is "on" or "off", "1" representing "on" and "0" representing "off". Column C 901 represents the "last state" output of the XOR gate 808, the C input to XOR gate 808. Column Q 904 represents the result of the three inputs, the output of the XOR gate 808 on the input.

Some examples of the "intelligent switching" can be seen using the truth table of FIG. 9. For a four-way design of the device, the two possible configuration would be a first switching configuration when the control switch is "off", input terminal A connected to output terminal C at the same time that input terminal B is connected to output terminal D; or a second switching configuration when the control switch is "on", input terminal B is connected to output terminal C at the same time that input terminal A is connected to output terminal D. Column C 901 represents the "last state" of the "intelligent switching" module, therefore "0" or "off" represents the second switching configuration and "1" or "on" represents the first switching configuration. Column B 902 indicates whether voltage is being provided to the load in the electrical circuit; the load will be referred to as "the light" in the examples below. Column A 903 indicates whether the control switch is "on" or "off" in the "next state".

Referring to the first line 905 of the truth table, in this example, "0" indicates that the device is in the first switching configuration (Column C), the light is "off" (Column B), and the request to turn the switch "off" (Column A) comes in e.g., from a Smartphone controlling a two-way Wi-Fi switch. Referring to Column Q, the result is a "0" which indicates that the "next state" should also be the first switching configuration. The effect is therefore to do nothing.

Referring to the third line 906 of the truth table, the only difference from the previous example is that in this example the light is "on", e.g., another switch in the electrical circuit turned the light "on" while the device configuration remained the same. A "0" indicates that the device is in the first switching configuration (Column C), the light is "on" (Column B), and the request to turn the switch "off" (Column A) comes in. Referring to Column Q, in this example the result is a "1" which indicates that the "next state" should be the second switching configuration therefore the device toggles.

Referring to the sixth line 907 of the truth table, a "1" indicates that the device is in the second switching configuration (Column C), the light is "off" (Column B), and the request to turn the switch "on" (Column A) comes in. Referring to Column Q, the result is a "0" which indicates that the "next state" should be the first switching configuration therefore the device toggles.

Generally the device allows a two-way switch to toggle the load from "on" to "off" or "off" to "on". However, when using the "intelligent switching" module, the device will not be allowed to toggle if the light is "on" and the request is for the light to turn "on" or if the light is "off" and the request is for the switch to turn "off".

FIG. 10 shows a component diagram of the "power source" circuit module in the three-way design of the device. Some specialty two-way switches are designed to power their internal electronic circuitry using the voltage derived from the terminal that is constantly connected to the AC mains voltage. The device uses the process of connecting and disconnecting the standard and specialty two-way control switch's terminals to each other to toggle the three-way or four-way switch design of the device, but the device can provide constant voltage to one of the terminals if required to power internal electronic circuitry, therefore specialty two-way switches designed to power their internal electronic circuitry using the voltage derived from the terminal that is constantly connected to the AC mains voltage can work with the device. The input pins 1004, 1005 to an optocoupler 1001 form an AC Mains 1006 circuit with the S1 terminal 1007 and the S2 terminal 1008. The S2 terminal 1008 is always connected to AC Mains and therefore can power the internal electronic circuitry of a switch if required; when the control switch across the S1 terminal 1007 and the S2 terminal 1008 is "on", i.e., the contacts are connected to each other, the AC Mains circuit is complete and optocoupler 1001 connects the "power source" module input lead 1002 to output lead 1003, therefore the specialty two-way control switch can work with the device. This "power source" circuit module can be incorporated into the "intelligent switching" circuit such that a control switch requiring AC Mains to power its internal circuitry can coexist with "intelligent switching".

Although this invention has been described in certain specific embodiments, many additional modifications and variations would be apparent to those skilled in the art. It is therefore to be understood that this invention may be practiced otherwise than as specifically described. Thus, the embodiments of the invention described herein should be considered in all respects as illustrative and not restrictive, the scope of the invention to be determined by the claims and their equivalents rather than the foregoing description.

What is claimed is:

1. An apparatus for use as a switch in an electrical circuit controlling voltage applied from a mains line to a load, the electrical circuit comprising a plurality of switches, the apparatus comprising: a) an input terminal coupled to either a hot conductor of the mains line, to the load, or to a previous switch in the electrical circuit, b) a first output terminal coupled to a next switch in the electrical circuit by a first traveler wire, c) a second output terminal coupled to the next switch in the electrical circuit by a second traveler wire, d) a first control terminal coupled to a first contact of a two-way switch, e) a second control terminal coupled to a second contact of the two-way switch, and (f) an internal switching mechanism; such that when the first contact of the two-way switch connects to or disconnects from the second contact of the two-way switch, the internal switching mechanism causes the input terminal to toggle between the first output terminal and the second output terminal.

2. The apparatus for use as a switch of claim 1, further comprising a second input terminal coupled to the previous switch in the electrical circuit; such that when the first contact of the two-way switch connects to or disconnects from the second contact of the two-way switch, the internal switching mechanism causes the second input terminal to connect to either of the first output terminal or the second output terminal that does not connect to the input terminal.

3. The apparatus for use as a switch of claim 1, in which the switch is a three-way switch.

4. The apparatus for use as a switch of claim 2, in which the switch is a four-way switch.

5. The apparatus for use as a switch of claim 1, further comprising a neutral terminal coupled to a neutral conductor of the mains line.

6. The apparatus for use as a switch of claim 1, further comprising a ground terminal coupled to a ground conductor of the mains line.

7. The apparatus for use as a switch of claim 1, in which the two-way switch is a standard on/off switch.

8. The apparatus for use as a switch of claim 1, in which the two-way switch is a tamper-resistant key switch.

9. The apparatus for use as a switch of claim 1, in which the two-way switch is a motion detection switch.

10. The apparatus for use as a switch of claim 1, in which the two-way switch is a thermostat switch.

11. The apparatus for use as a switch of claim 1, in which the two-way switch is an Internet-enabled switch responsive to wireless signals originating from a Smartphone device, received directly or via a wireless router connection.

* * * * *